US005692345A

United States Patent [19]

Mogaki et al.

[11] Patent Number: 5,692,345

[45] Date of Patent: Dec. 2, 1997

[54] PANEL JOINING MECHANISM

[75] Inventors: Yukinori Mogaki; Shigieru Suzuki; Shunroku Seno, all of Fukuoka, Japan

[73] Assignee: Toto Ltd., Fukuoka, Japan

[21] Appl. No.: 432,181

[22] PCT Filed: Nov. 8, 1993

[86] PCT No.: PCT/JP93/01617

§ 371 Date: May 5, 1995

§ 102(e) Date: May 5, 1995

[87] PCT Pub. No.: WO94/11588

PCT Pub. Date: May 26, 1994

[30] Foreign Application Priority Data

Nov. 6, 1992 [JP] Japan ..... 4-082801 U

[51] Int. Cl.[6] ..... E04B 2/72; E04H 1/12

[52] U.S. Cl. ..... 52/483.1; 52/34; 52/36.6; 52/489.1; 52/506.09

[58] Field of Search ..... 52/483.1, 506.06, 52/506.08, 506.09, 508, 512, 482, 489.1, 34, 36.6, 220.5

[56] References Cited

U.S. PATENT DOCUMENTS

| | | | |
|---|---|---|---|
| 1,997,939 | 4/1935 | Loucks | 52/506.08 |
| 3,381,438 | 5/1968 | Bohnsack | 52/584.1 X |
| 3,667,183 | 6/1972 | Heirich | 52/506.06 |
| 3,694,981 | 10/1972 | Cremer et al. | 52/506.08 X |
| 3,832,820 | 9/1974 | Eggert | 52/506.08 X |
| 4,581,859 | 4/1986 | Doke et al. | 52/36.6 |
| 4,703,593 | 11/1987 | Smolik | 52/34 |
| 4,720,946 | 1/1988 | Pagliarello | 52/506.06 X |
| 4,987,619 | 1/1991 | Smith | 52/34 X |

FOREIGN PATENT DOCUMENTS

| | | | |
|---|---|---|---|
| 2443242 | 5/1976 | Germany | 52/506.09 |
| 59-168414 | 11/1984 | Japan . | |
| 60-40722 | 12/1985 | Japan . | |
| 63-1726 | 1/1988 | Japan . | |
| 63-1727 | 1/1988 | Japan . | |
| 63-41475 | 10/1988 | Japan . | |
| 0125138 | 7/1989 | Japan . | |
| 63-13340 | 8/1994 | Japan | 52/483.1 |

*Primary Examiner*—Carl D. Friedman
*Assistant Examiner*—Winnie Yip
*Attorney, Agent, or Firm*—Weiner, Carrier, Burt & Esser, P.C.; Joseph P. Carrier; Irving M. Weiner

[57] ABSTRACT

A panel joining mechanism (1) has a post (10) composed of a flat rear wall (11) adapted to be positioned in confronting relation to an attachment (40) for being securely joined to the attachment (40), and a pair of side walls (12) extending from respective opposite ends of the flat rear wall (11) away from the attachment (40), the side walls (12) having respective ends bent inwardly into a pair of respective bent portions (13) with an opening defined therebetween, a panel joiner (20) having a substantially inverted Ω-shaped cross section and disposed between the bent portions (13), at least a pair of panels (30L, 30R) having respective elastic portions (34L, 34R) on respective marginal side edges thereof. The panel joiner is detachably fitted in the post (10) through the opening, and the panels (30L, 30R) are joined to the panel joiner (20) with corresponding ones of the elastic portions (34L, 34R) detachably fitted in the panel joiner (20).

28 Claims, 11 Drawing Sheets

PANEL JOINING MECHANISM

TECHNICAL FIELD

The present invention relates to a panel joining mechanism for joining a plurality of wall panels or partition panels.

BACKGROUND ART

There have been proposed various joining structures and fixtures for joining wall panels or partition panels for unit bathrooms. Reference numerals given in parentheses below refer to those indicated in the drawings of publications of the background art.

Japanese utility model publication No. 60-40722 discloses a joining structure as a first background art arrangement. As shown in FIG. 5 of the publication, the joint structure has a joint member (12) (see its FIG. 6) fitted in a post (11) and panels (1), (1) having hook fingers (4), (4) inserted in the joint member (12). The joint member (12) has deep grooves (12*c*), (12*c*) in which attachment members (11'), (11') of the post (11) are fitted, respectively. Therefore, the joint member (12) is movable along the grooves (12*c*) with respect to the post (11), allowing the panels (1), (1) to be easily attached to the joint member (12).

Japanese laid-open utility model publication No. 59-168414 discloses, a second background art arrangement, a fixture (1) for joining panels (3), (4) to each other. When the fixture (1) is fitted in a channel-shaped stud (2) and engaging members (11), (11) on ends of the panels (3), (4) are inserted into the fixture (1), the panels (3), (4) are joined to each other and fixed to the stud (2).

As shown in FIG. 2 of the publication, the fixture (1) is formed by bending a thin metal sheet a number of times, and has a shape that can elastically be deformed.

The relevance of the two background art structures described above resides in that panels can easily be attached to a post or a stud by a joint member or a fixture.

There is a demand for modifying a finished bathroom by attaching an accessory such as a lavatory bowl to a wall of the bathroom. Since the lavatory bowl is heavy, it should not simply be fastened to a wall panel by screws.

It has been customary to detach a wall panel, remove a joint member or a fixture, put an accessory attachment plate between exposed posts or studs, fasten opposite ends of the accessory attachment plate to the posts or studs, attach the joint member or the fixture again, and then attach the wall panel again to the joint member or the fixture. Thereafter, a lavatory bowl is fastened to the accessory attachment plate behind the wall panel.

Therefore, it is necessary to remove panels for rearranging bathrooms.

In terms of rearranging a bathroom, the first background art arrangement is disadvantageous in that, as shown in FIG. 5 of the publication, since the tip ends of J-shaped hook fingers (4) engage steps (accompanied by no reference numerals) of the joint member (12), attempts to force the panels (1) off tend to deform the hook fingers (4) or break the steps of the joint members (12).

With the second prior art arrangement, a pattern of spaced fixtures (1) which are of a small length, as shown in FIG. 1 of the publication, allows steam to leak out of the bathroom through gaps. If an elongate fixture (1) as long as the stud (2) is used to avoid the steam leakage, then it will not be easy to detach the fixture (1) from the stud (2). This is because steps (14), (14) of the fixture (1) interlock with tip ends (8), (8) of flanges (7), (7) of the stud (2). If intensive forces are applied to remove the fixture (1), then the fixture (1) is liable to be deformed largely and may not be used again.

As described above, the conventional joining structures are addressed to attachment of panels only, and are not suitable for detaching and reattaching panels.

DISCLOSURE OF THE INVENTION

In view of the above problems, it is an object of the present invention to provide a panel joining mechanism which allows panels to be detached and reattached without applying undue forces and repeatedly.

A panel joining mechanism according to the present invention comprises a post composed of a flat rear wall adapted to be positioned in confronting relation to an attachment for being securely joined to the attachment, and a pair of side walls extending from respective opposite ends of the flat rear wall away from the attachment, the side walls having respective ends bent inwardly into a pair of respective bent portions with an opening defined therebetween, a panel joiner having a substantially inverted Ω-shaped cross section and disposed between the bent portions, and at least a pair of panels having respective elastic portions on respective marginal side edges thereof. The panel joiner is detachably fitted in the post through the opening, and the panels are joined to the panel joiner with corresponding ones of the elastic portions detachably fitted in the panel joiner.

To detach the panels, the elastic portions may be removed from the panel joiner. When necessary, the panel joiner may also be removed from the post.

The panel joiner has a soft member held against the elastic portions to apply elastic forces for keeping the panels strongly attached to the post and make the panel joining mechanism highly water-tight.

BRIEF DESCRIPTION OF THE DRAWINGS

FIG. 2(*b*) is a cross-sectional view showing an example of dimensions of various parts of an elastic portion on a panel side edge in the first embodiment;

BEST MODE FOR CARRYING OUT THE INVENTION

Preferred embodiments of the present invention will be described below with reference to the accompanying drawings.

Figure 1:
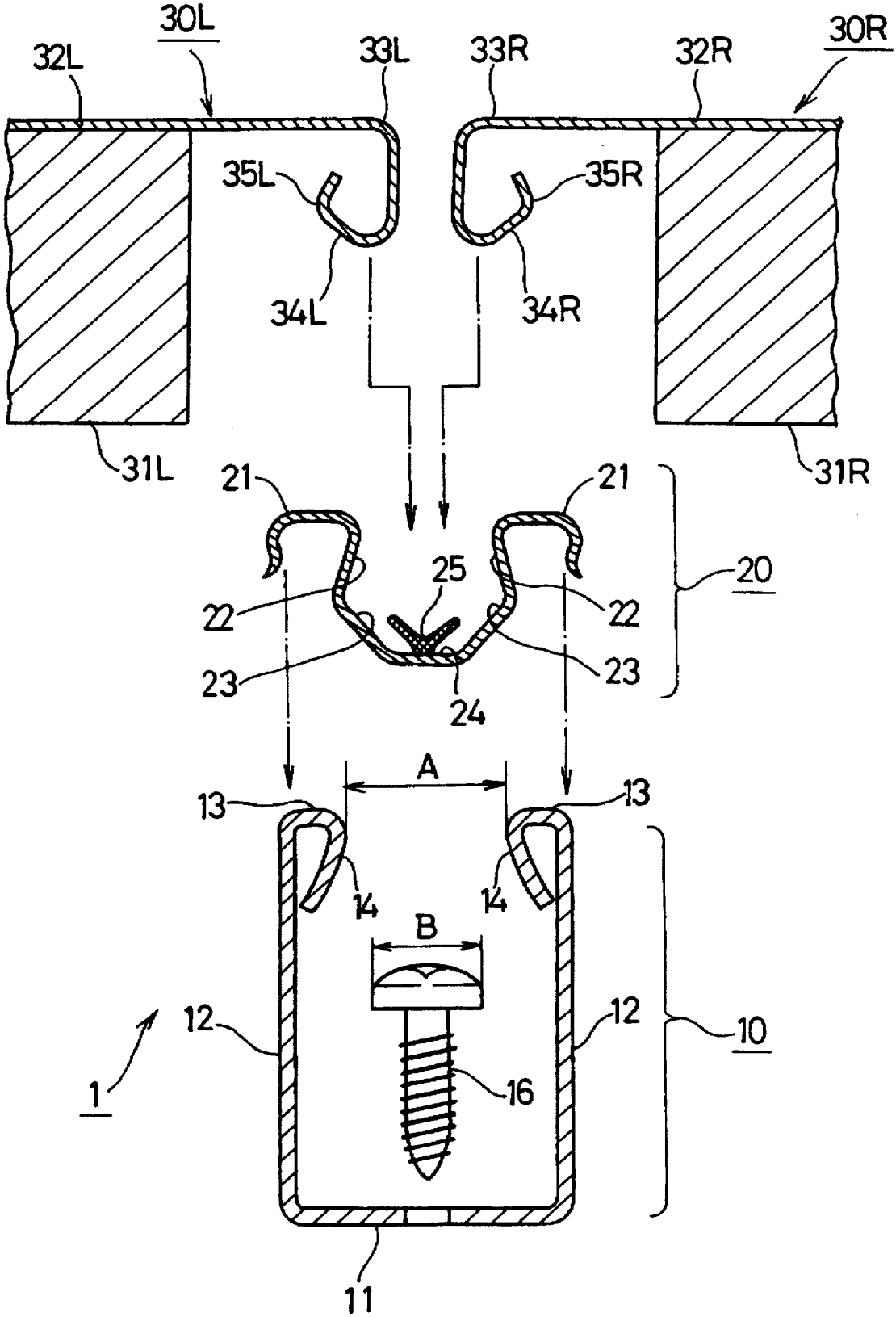
FIG. 1 is an exploded horizontal cross-sectional view of a panel joining mechanism according to a first embodiment of the present invention.

FIG. 1 is an exploded horizontal cross-sectional view of a panel joining mechanism according to a first embodiment of the present invention. The panel joining mechanism, generally denoted at 1, comprises a post or post member 10, a panel joiner 20, a pair of panels 30L, 30R (L indicates a left panel and R a right panel).

The post 10 is formed by bending a steel sheet or the like into a channel shape composed of a rear wall 11 and a pair of side walls 12, bending opposite ends of the side walls 12 into bent portions 13 having slanted portions 14 which confront each other with a relatively large opening defined therebetween.

The opening has an inside dimension A that is larger than the dimension B of the head of a screw 16 which fastens the post 10 to an attachment member such as an accessory attachment plate or a building wall.

The screw 16 can thus easily be inserted through the opening for engagement with the post 10.

The panel joiner 20 is made of a material having medium hardness which is both elastically deformable and rigid. The panel joiner 20 is an elongate member having a substantially inverted Ω-shaped cross section, and is composed of a pair of wings 21, a pair of first slanted walls 22 joined respectively to the wings 21, a pair of second slanted walls 23 joined respectively to the first slanted walls 22, a rear wall 24 joining the second slanted walls 23 to each other, and a Y- or V-shaped soft member 25 projecting from the rear wall 24.

Figure 2:
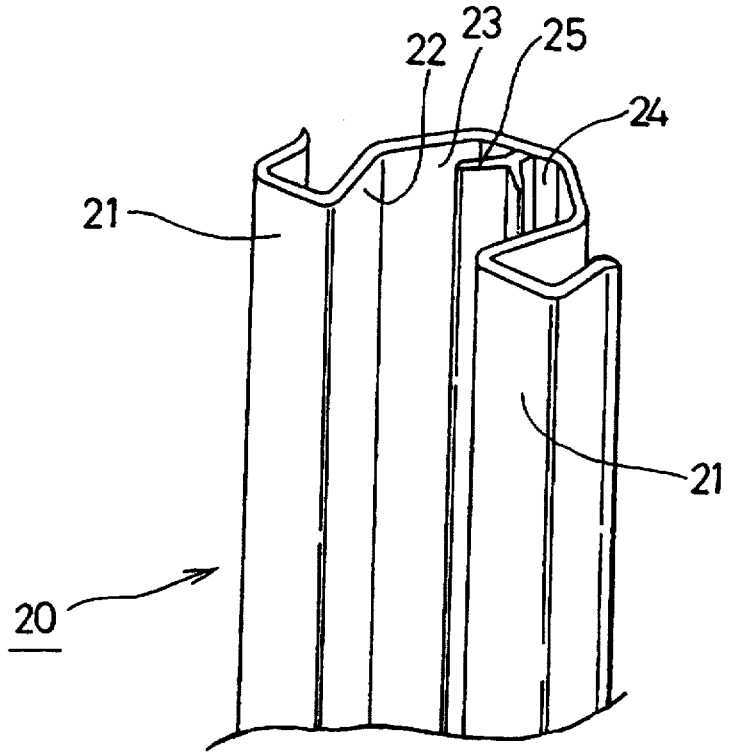
FIG. 2(*a*) is a fragmentary perspective view of a panel joiner in the panel joining mechanism according to the first embodiment.
Figure 2:
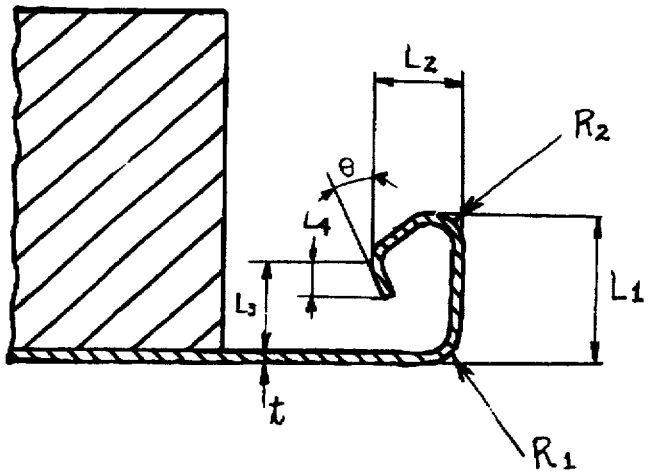

FIG. 2(*a*) is a perspective view of the panel joiner 20 in the first embodiment. The panel joiner 20 is of an elongate dimension which is substantially the same as the height of the panels, and has a shape that is suitable for being produced by extrusion molding.

Specifically, the panel joiner 20 is manufactured by extrusion-molding different materials simultaneously or at slightly different times according to the two-color extrusion molding process such that a soft material is extrusion-molded on a medium-hardness material.

Referring back to FIG. 1, the panels 30L, 30R comprise respective surface members 32L, 32R lined respectively by lining members 31L, 31R such as of plaster board, asbestos, glass wool, or the like. The surface members 32L, 32R are preferably in the form of decorative metal sheets, and may comprise steel sheets coated with vinyl chloride layers, for example. Preferably, the steel sheets have a thickness of 0.45 mm, the vinyl chloride layers have a thickness ranging from 0.15 to 0.25 mm, and the total thickness thereof including back coating ranges from 0.5 to 1.5 mm. The surface members 32L, 32R may alternatively comprise painted steel sheets, colored aluminum sheets, stainless steel sheets, painted stainless steel sheets, decorative aluminum sheets coated with vinyl chloride layers, or decorative sheets of titanium, copper, brass, or the like.

The panels 30L, 30R have respective marginal side edges 33L, 33R bent backwards (toward the exterior) into elastic or spring portions 34L, 34R of a substantially J-shaped cross section. The elastic portions 34L, 34R have distal ends bent into convex edges 35L, 35R of an L-shape cross section.

The elastic portions 34L, 34R of the panels 30L, 30R have various dimensions which preferably include, as shown in FIG. 2(*b*), a length $L_1$ of about 9.1 mm, a length $L_2$ of about 5.5 mm, a length $L_3$ of about 5 mm, a length $L_4$ of about 4.5 mm, radii $R_1$ and $R_2$ of about 2 mm, and an angle θ of about 30°. However, the dimensions are not limited to these specific values, but may be varied depending on various conditions.

A sequence of assembling the panel joining mechanism 1 of the above structure will be described below.

Figure 3:
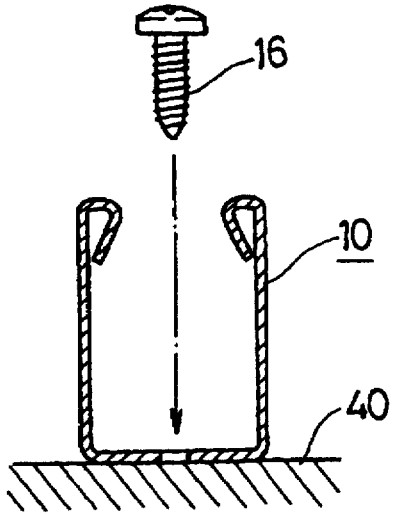
FIGS. 3(*a*) through 3(*d*) are cross-sectional views illustrative of a sequence of assembling the panel joining mechanism according to the first embodiment.
Figure 3:
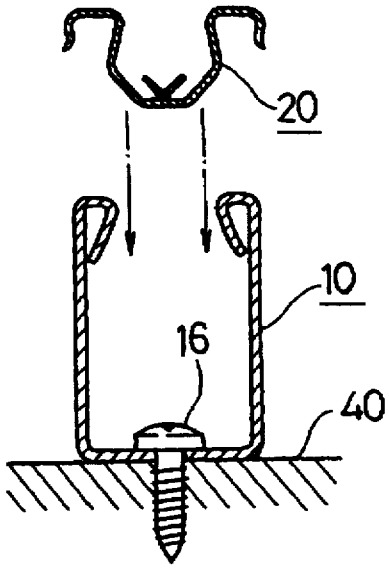
Figure 3:
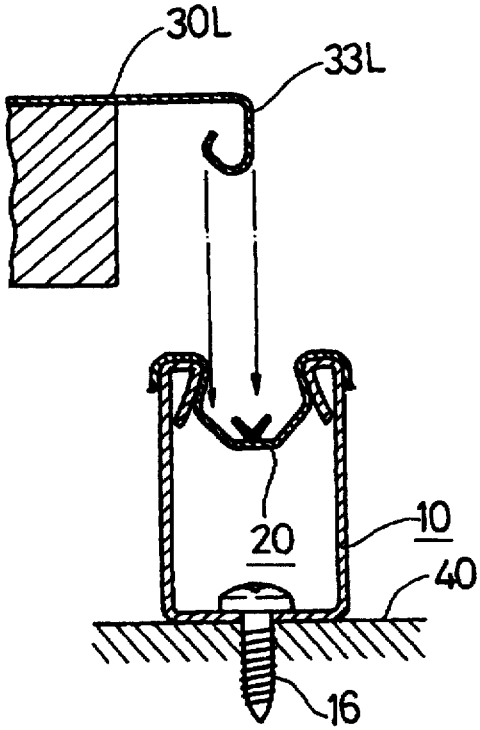
Figure 3:
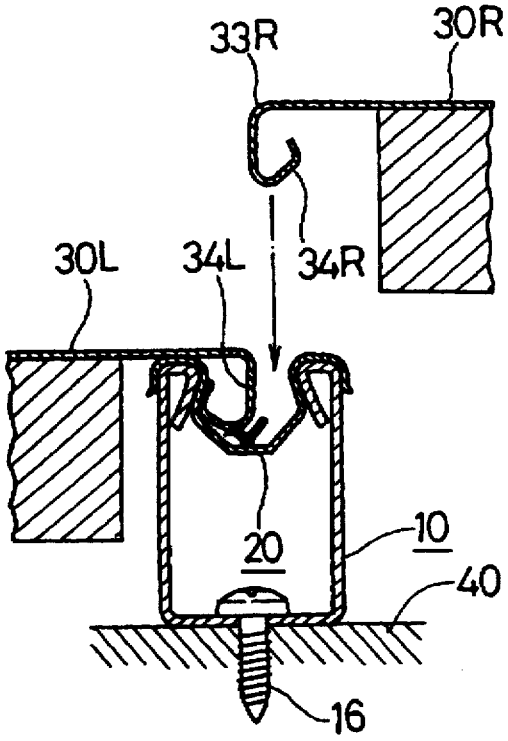

FIGS. 3(*a*) through 3(*d*) are cross-sectional views illustrative of a sequence of assembling the panel joining mechanism according to the first embodiment.

As shown in FIG. 3(*a*), the rear wall 11 of the post 10 is held against a wall 40 of a building structure, for example, and fastened thereto by a screw 16.

As shown in FIG. 3(*b*), the panel joiner 20 is placed into the opening between the bent portions 13 or the slanted portions 14 of the side walls 12 which extend from the opposite ends of the rear wall 11 in a direction away from the wall 40.

As shown in FIG. 3(*c*), the resilient portion 34L on the marginal edge portion 33L of the panel 30L is then attached to the panel joiner 20.

As shown in FIG. 3(*d*), the resilient portion 34R on the marginal edge portion 33R of the panel 30R is attached to the panel joiner 20. At this time, the elastic portions 34L, 34R of the panels 30L, 30R can easily be inserted into the panel joiner 20 as the elastic portions 34L, 34R are elastically deformable.

Figure 4:
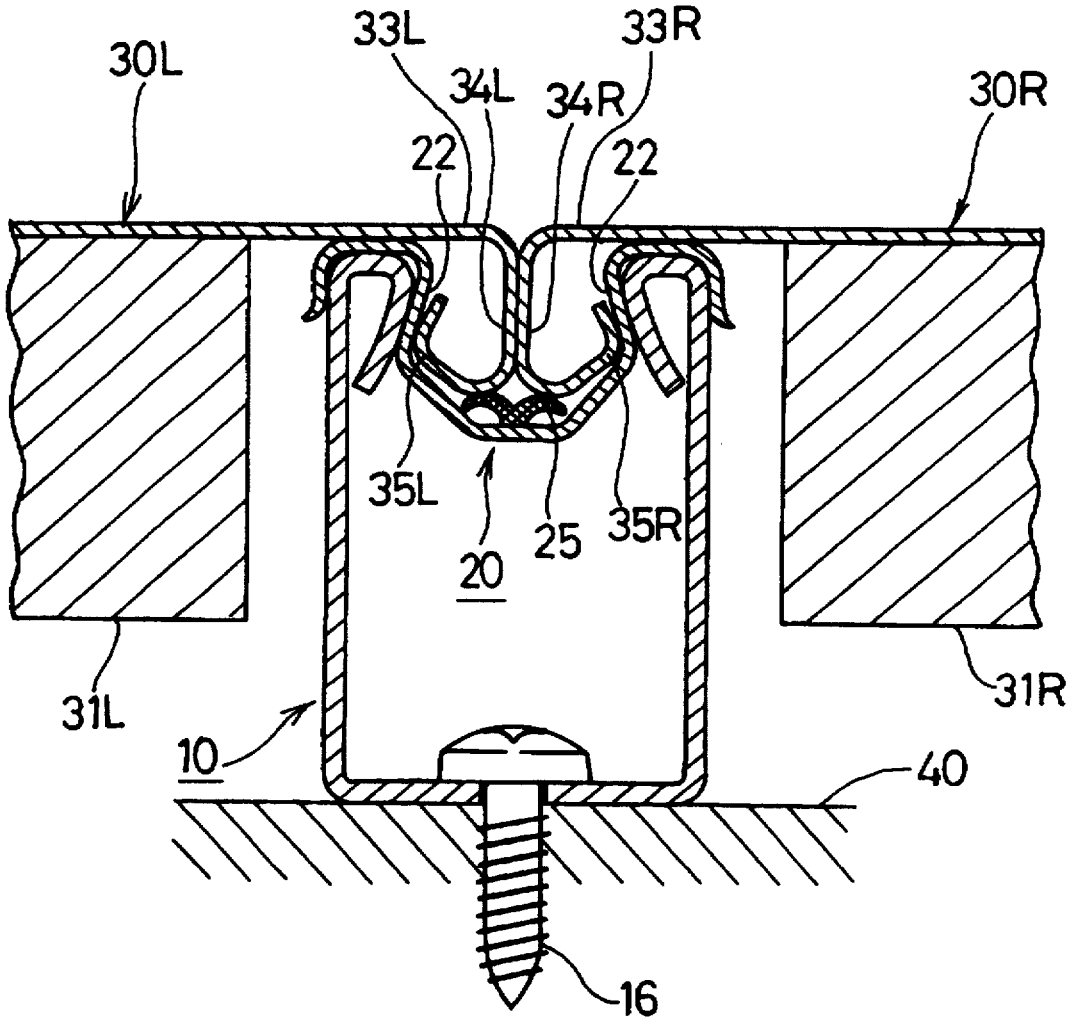
FIG. 4 is a cross-sectional view of an assembled form of the panel joining mechanism according to the first embodiment.

FIG. 4 is a cross-sectional view of an assembled form of the panel joining mechanism according to the first embodiment. As shown in FIG. 4, when the elastic portions 34L, 34R of the panels 30L, 30R are inserted and fitted in the panel joiner 20, the soft member 25 of the panel joiner 20 serves as an elastic pressing means for elastically pressing back the elastic portions 34L, 34R in a direction opposite to the direction in which the elastic portions 34L, 34R have been inserted. Therefore, the convex edges 35L, 35R of the panels 30L, 30R are pressed under constant forces against the respective first slanted walls 22 of the panel joiner 20 by the soft member 25 that acts as the elastic pressing means, thereby securing the panels 30L, 30R firmly to the post 10 through the panel joiner 20.

A process of posteriorly installing an accessory such as a lavatory bowl in a bathroom which has been assembled using such panel joining mechanisms will be described below. The drawings should be observed in the direction in which the reference numerals appear normally.

Figure 5:
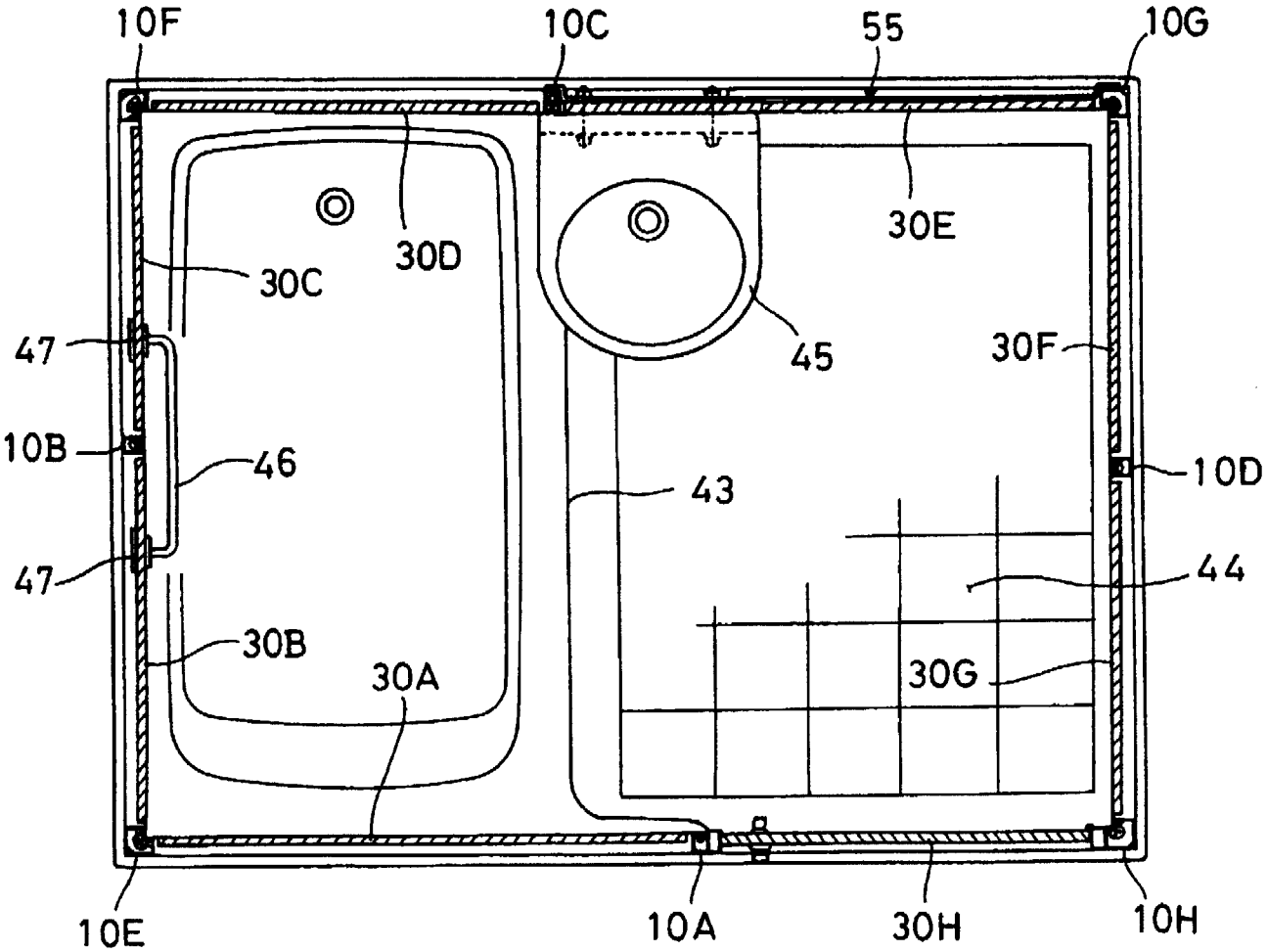
FIG. 5 is a plan view of a bathroom assembled using panel joining mechanisms according to the first embodiment, with a posteriorly installed lavatory bowl.

FIG. 5 is a plan view of a bathroom assembled using panel joining mechanisms according to the first embodiment, with a posteriorly installed lavatory bowl. The bathroom has a bathtub 43 and a floor 44 which are surrounded by panels 30A~30G, which are equivalent to the panels 30L, 30R, and a doored panel 30H.

These panels 30A~30G, 30H are supported by posts 10A~10D, which are equivalent to the post 10, and corner posts 10E~10H.

The lavatory bowl, denoted at 45, is newly attached to the panel 30E.

A handrail 46 is affixed to the panels 30B, 30C at its areas that are reinforced by reinforcing wood members 47 applied to the back sides of the panels 30B, 30C.

Figure 6:
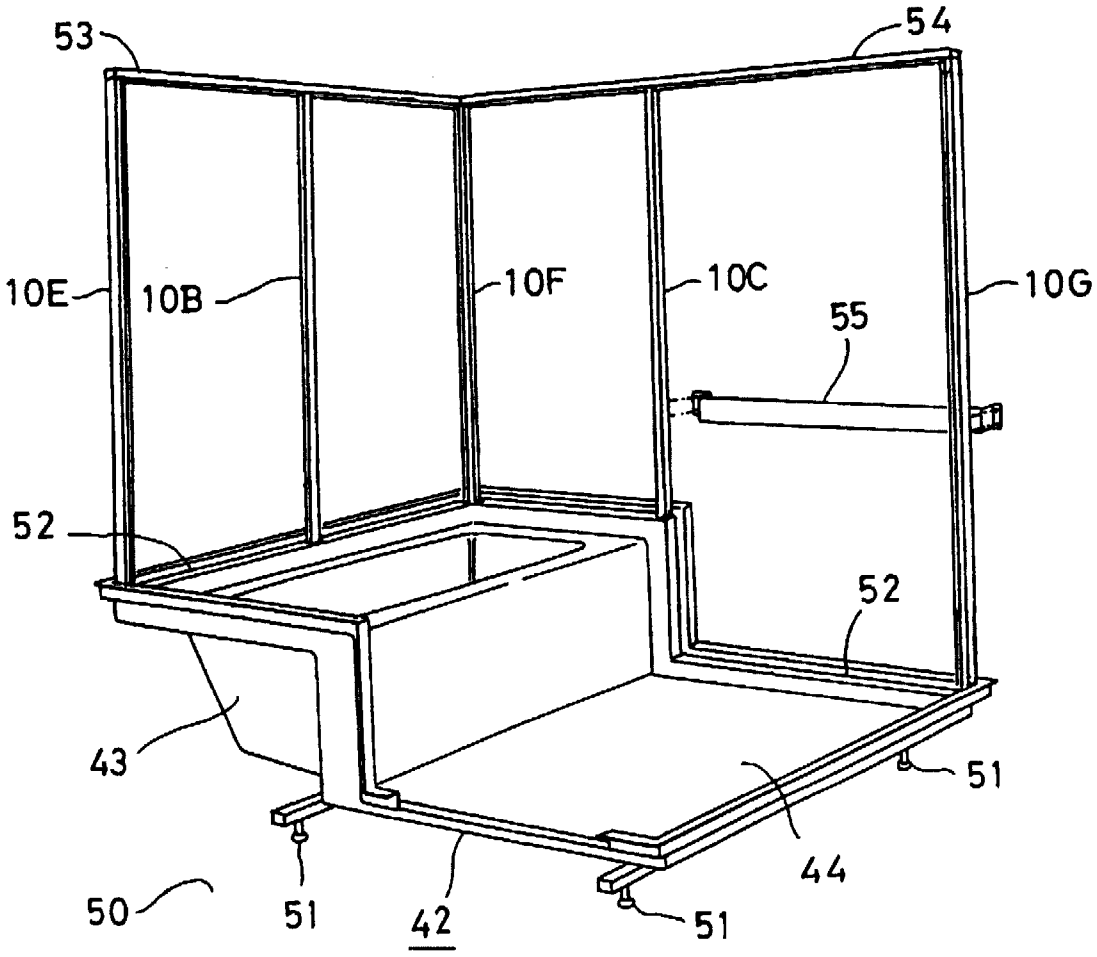
FIG. 6 is a perspective view of components, including a floor, posts, etc. of the bathroom produced using panel joining mechanisms according to the first embodiment.

FIG. 6 shows in perspective the floor, the posts, etc. of the bathroom. Only parts of the bathrooms are shown for a fuller understanding of the positions where the posts are installed. The posts for only two walls are illustrated in FIG. 6.

The posts 10E, 10B, 10F, 10C, 10G are vertically disposed on a rim 52 around a floor pan 42. The posts 10A, 10D, 10H are omitted from illustration.

The bathroom is placed on a building floor 50 through adjusters 51 which serve to level the floor pan 42. Horizontal members 53, 54 are mounted on the upper ends of the posts 10E, 10B, 10F, 10C, 10G, and also on the upper ends of the posts 10A, 10D, 10H which are omitted from illustration.

An accessory attachment plate 55 serves to install the lavatory bowl 45. A process of attaching the accessory attachment plate 55 will be described later on with reference to FIGS. 9(*a*) through 9(*e*).

Figure 7:
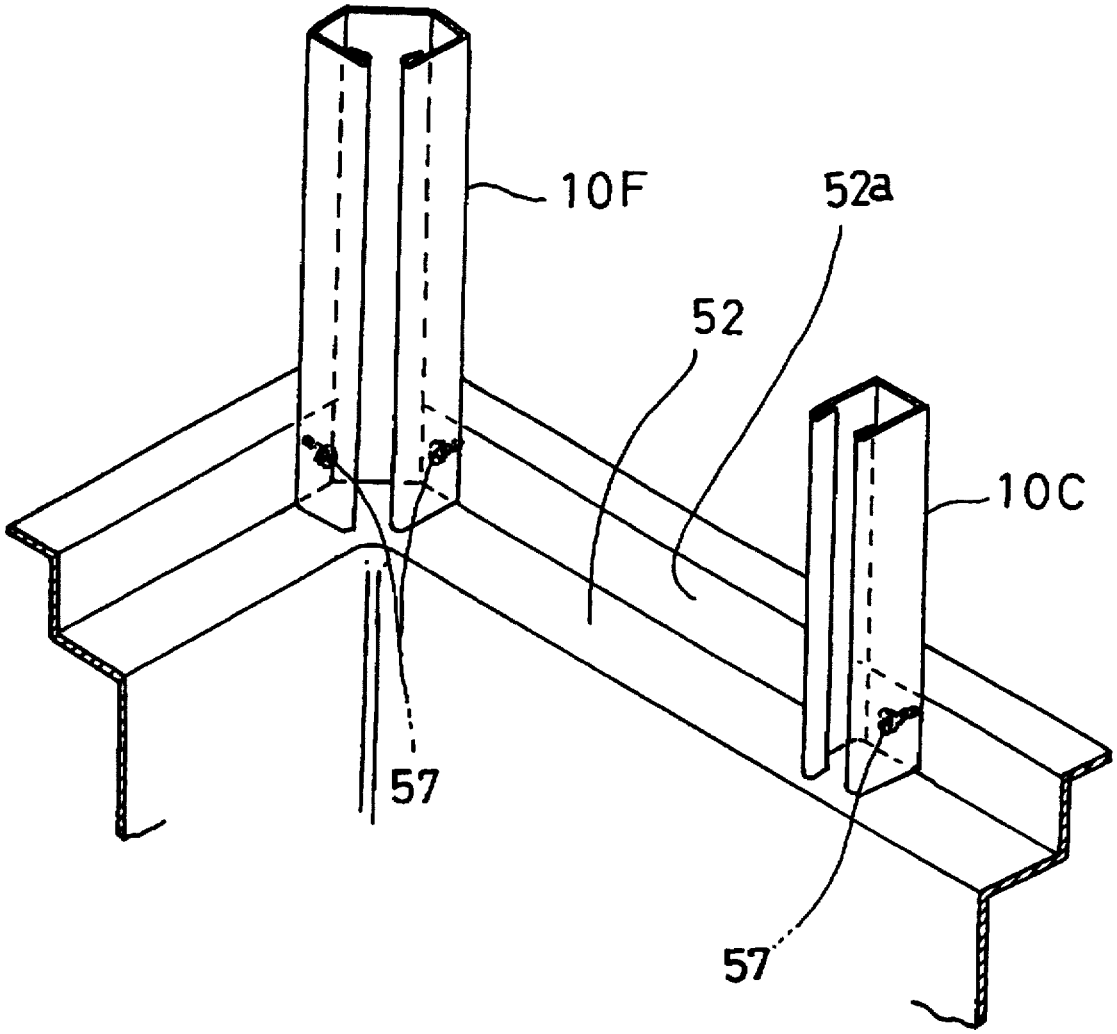
FIG. 7 is a fragmentary perspective view showing a structure by which the lower ends of posts are attached to an attachment according to the first embodiment.

FIG. 7 is a fragmentary perspective view showing a structure by which the lower ends of posts are attached to the rim 52. Specifically, the pests 10A~10H shown in FIG. 5 are fixed to the rim 52 around the floor pan 42 as follows:

The posts 10C, 10F are placed on the rim 52 and fastened to vertical walls 52*a* of the rim 52 by screws 57. The other posts are attached to the rim 52 in the same manner.

Since the posts 10C, 10F and so on are mounted on the rim 52, any water that enters from within the bathroom through a joint between panels, i.e., the joint between the elastic portions 34L, 34R shown in FIG. 4, into the panel joiner 20 falls on an inner side surface of the panel joiner 20, and flows along the rim 52 into the bathtub 43 or floor 44. The water is prevented from flowing out of the bathroom beyond the vertical walls 52*a* of the rim 52.

Figure 8:
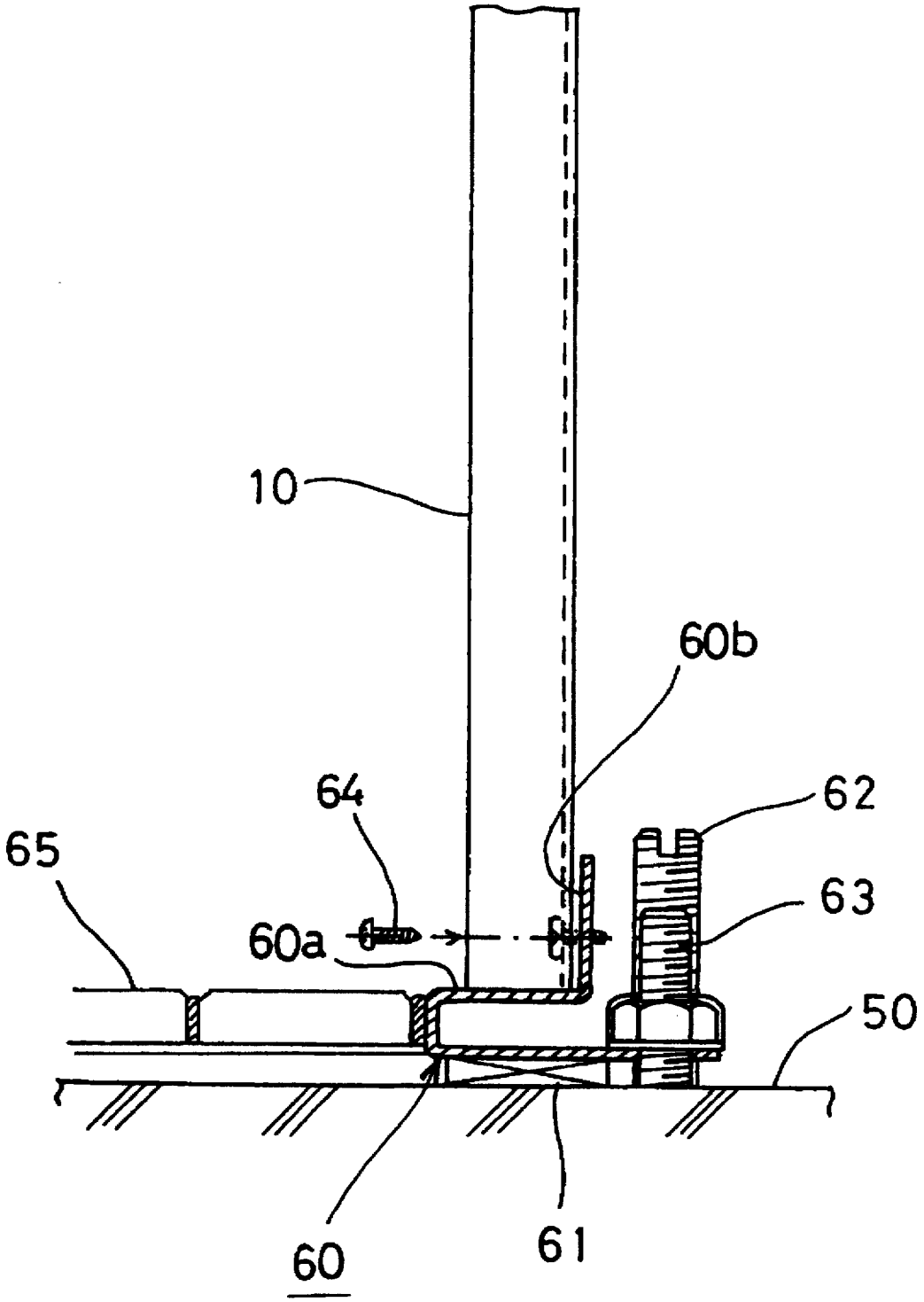
FIG. 8 is an elevational view showing another structure by which the lower ends of posts are attached to an attachment.
Figure 9A:
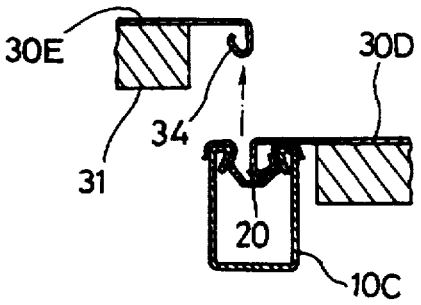
FIGS. 9(*a*) through (*e*) are cross-sectional views showing a sequence of posteriorly installing a lavatory bowl in the bathroom assembled using panel joining mechanisms according to the first embodiment.
Figure 9B:
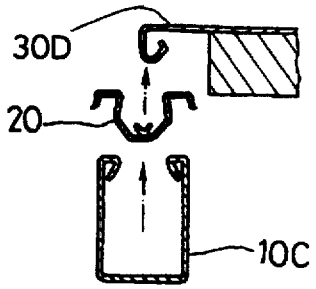
Figure 9C:
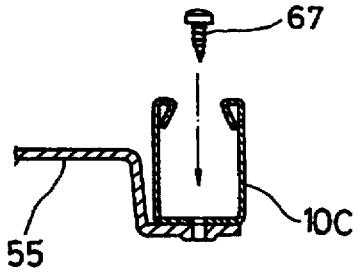
Figure 9D:
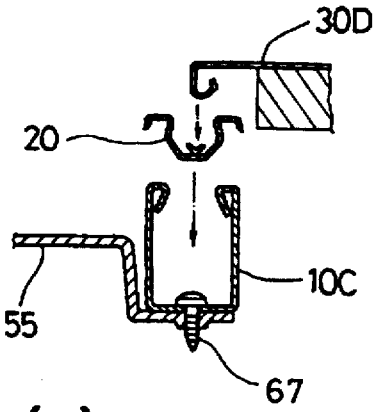
Figure 9E:
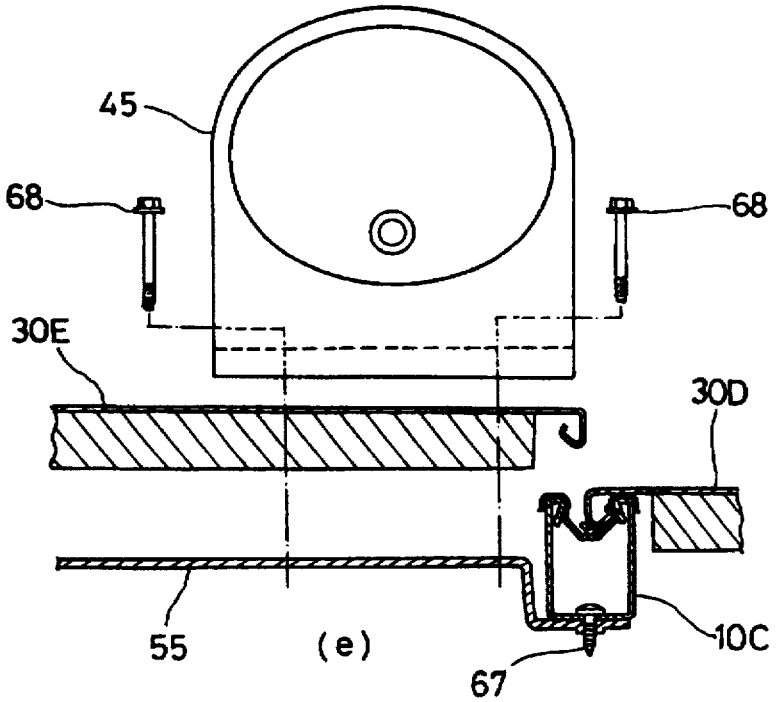

FIG. 8 is an elevational view showing another structure by which the lower ends of posts are attached to an attachment. In FIG. 8, a post 10 is vertically mounted on a floor border 60.

Specifically, the floor border 60 is placed on a liner 61 mounted on a building floor 50, leveled by an adjustment bolt 62, and fixed by an anchor bolt 63.

The post 10 is placed on a bearing surface 60*a* of the floor border 60, and directly fastened to a vertical wall 60*b* of the floor border 60 by a screw 64.

Even if water enters from within the bathroom through a joint between panels, i.e., the joint between the elastic portions 34L, 34R shown in FIG. 4, into the panel joiner 20, the water falls on an inner side surface of the panel joiner 20, and flows along the bearing surface 60*a* of the border 60 into the bathtub 43 or floor 44. The water is prevented from flowing out of the bathroom beyond the vertical wall 60*b* of the border 60.

FIGS. 9(*a*) through (*e*) are cross-sectional views showing a sequence of posteriorly installing a lavatory bowl in the bathroom described above according to the first embodiment. The sequence which includes removal of existing panels, attachment of a lavatory bowl attachment plate 55, reattachment of the panels, and attachment of a lavatory bowl will be described below.

As shown in FIG. 9(*a*), the panel 30E is detached from the panel joiner 20 in the post 10C. The panel 30E can easily be removed because the elastic portions 34 of the panels 30D, 30E are elastically deformable.

As shown in FIG. 9(*b*), the panel 30D is detached, and then the panel joiner 20 is removed from the post 10C, which is now exposed to view.

As shown in FIG. 9(*c*), the lavatory bowl attachment plate 55 as an accessory attachment plate is held against a rear surface of the post 10*c*, and fastened thereto by a screw 67.

As shown in FIG. 9(*d*), the panel joiner 20 and the panel 30D are re-attached to the post 10C.

As shown in FIG. 9(*e*), the panel 30E is attached, and thereafter a lavatory bowl 45 is attached. Specifically, the lavatory bowl 45 is attached directly to the lavatory bowl attachment plate 55 by screws 68 extending through through holes that are defined in the panel 30E from its face to back sides.

The bathroom with the lavatory bowl 45 shown in FIG. 5 is now completed.

In the above bathroom with the lavatory bowl 45, the lavatory bowl attachment plate 55 is fastened to the two adjacent posts 10C, 10G by respective screws 67 and extends between the posts 10C, 10G. However, the present invention is not limited to such a structure. Rather, the lavatory bowl attachment plate 55 may be joined to more than two adjacent posts, and the lavatory bowl may be joined to the lavatory bowl attachment plate 55 through a panel.

The panel joiner 20 is water-tight because it is of a closed shape as shown in horizontal cross section in FIG. 4. Specifically, even if water or steam leaks out of the bathroom through a small gap which may exist in the joint between the elastic portions 34L, 34R, the water or steam is prevented by the panel joiner 20 from going beyond the panel joiner 20. Therefore, it is not necessary to press a joint finishing material into any gap in the joint between the elastic portions 34L, 34R, or to cover the marginal side edges 33L, 33R with a sealing material. The panel joining mechanism 1 is therefore of a sightly appearance which is free of any joint finishing material.

The soft member 25 of the panel joiner 20 makes the panel joining mechanism 1 water-tight more completely.

Figure 10:
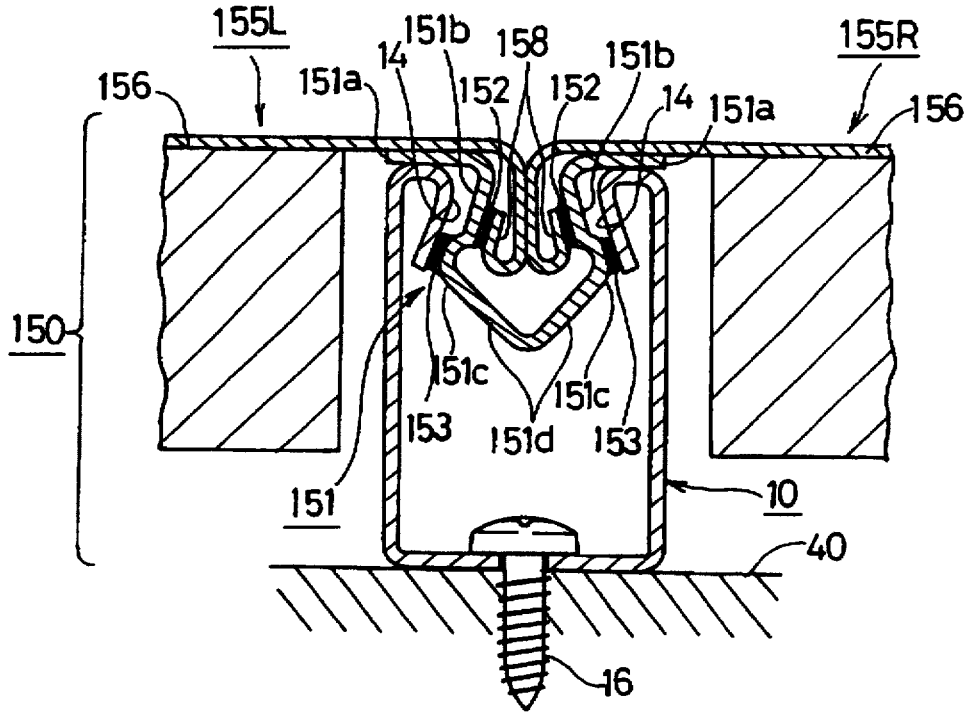
FIG. 10 is a horizontal cross-sectional view of a panel joining mechanism according to a second embodiment of the present invention.

FIG. 10 is a horizontal cross-sectional view of a panel joining mechanism according to a second embodiment of the present invention. The panel joining mechanism, generally denoted at 150, comprises a post 10, a panel joiner 151, and a pair of panels 155L, 155R (L indicates a left panel and R a right panel).

The post 10 is identical to the post 10 according to the first embodiment, and hence will not be described in detail below.

The panel joiner 151 is an elongate member having a substantially inverted Ω-shaped cross section similar to a spade mark, and is composed of a pair of flat wings 151*a*, a pair of first slanted walls 151*b* joined respectively to the flat wings 151*a*, a pair of convex edges 151*c* joined respectively to the first slanted walls 151*b*, a pair of second slanted walls 151*d* joined respectively to the convex edges 151*c* and to each other, a pair of soft members 152 integrally formed with respective inner surfaces of the first slanted walls 151*b*, and a pair of soft members 153 integrally formed with respective outer surfaces of the convex edges 151*c*.

The panels 155L, 155R have respective surface members 156 including respective elastic or spring portions 158 on marginal side edges thereof, the elastic or spring portions 158 being bent into a substantially J-shaped cross section. However, the elastic or spring portions 158 are smaller than the elastic portions 34L, 34R according to the first embodiment.

When the panels 155L, 155R are attached to the post 10 by the panel joiner 151 as shown in FIG. 10, the soft members 152 elastically press the elastic portions 158 inwardly and react to push the convex edges 151*c* outwardly, thus pressing the soft members 153 strongly against the slanted portions 14 of the post 10.

Therefore, the panels 155L, 155R are firmly fixed to the post 10 by the panel joiner 151. The soft members 152 serve as an elastic pressing means for elastically pressing the elastic portions 158 inwardly, and also elastically pressing the convex edges 151*c* or the soft members 153 outwardly. The soft members 152 and the soft members 153 jointly serve to make the panel joiner 151 more water-tight. Since the soft members 152, 153 are also elastic, the elastic portions 158 are required to be less elastic than they would be if the soft members 152, 153 were not present, and hence may be relatively small in size.

Figure 11:
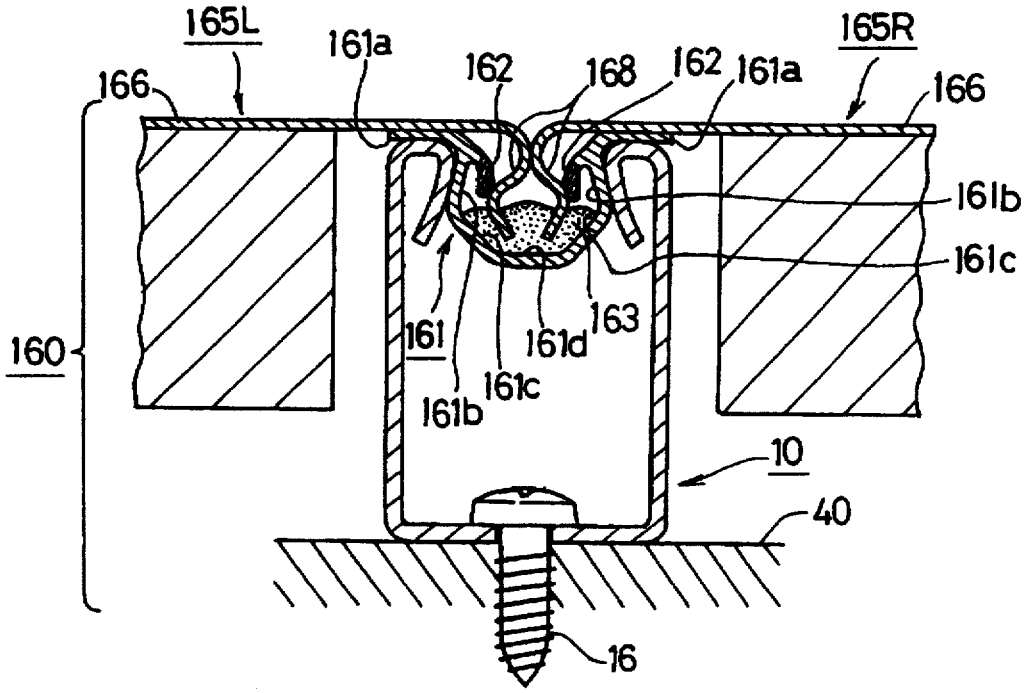
FIG. 11 is a horizontal cross-sectional view of a panel joining mechanism according to a third embodiment of the present invention.

FIG. 11 is a horizontal cross-sectional view of a panel joining mechanism according to a third embodiment of the present invention. The panel joining mechanism, generally denoted at 160, comprises a post 10, a panel joiner 161, and a pair of panels 165L, 165R (L indicates a left panel and R a right panel).

The post 10 is identical to the post 10 according to the first embodiment, and hence will not be described in detail below.

The panel joiner 161 is an elongate member having a substantially inverted Ω-shaped cross section, and comprises a pair of flat wings 161*a*, a pair of first slanted walls 161*b* joined respectively to the flat wings 161*a*, a pair of second slanted walls 161*c* joined respectively to the first slanted walls 161*b*, a rear wall 161*d* joined to the second slanted walls 161*c*, a pair of soft members 162 extending inwardly respectively from the first slanted walls 161*b* and serving as an elastic pressing means, and a filler sealant 163 disposed in the panel joiner 161.

The panels 165L, 165R have respective surface members 166 including respective elastic or spring portions 168 on marginal side edges thereof, the elastic or spring portions 168 being bent into a substantially S-shaped cross section. When the elastic portions 168 of the panels 165L, 165R are inserted into the panel joiner 161, the soft members 162 elastically press the elastic portions 168 inwardly to produce forces tending to retain the panels 165L, 165R on the post 10. The elastic portions 168 have respective distal ends embedded in the filler sealant 163 in the panel joiner 161, making the panel joiner 161 more water-tight.

Figure 12:
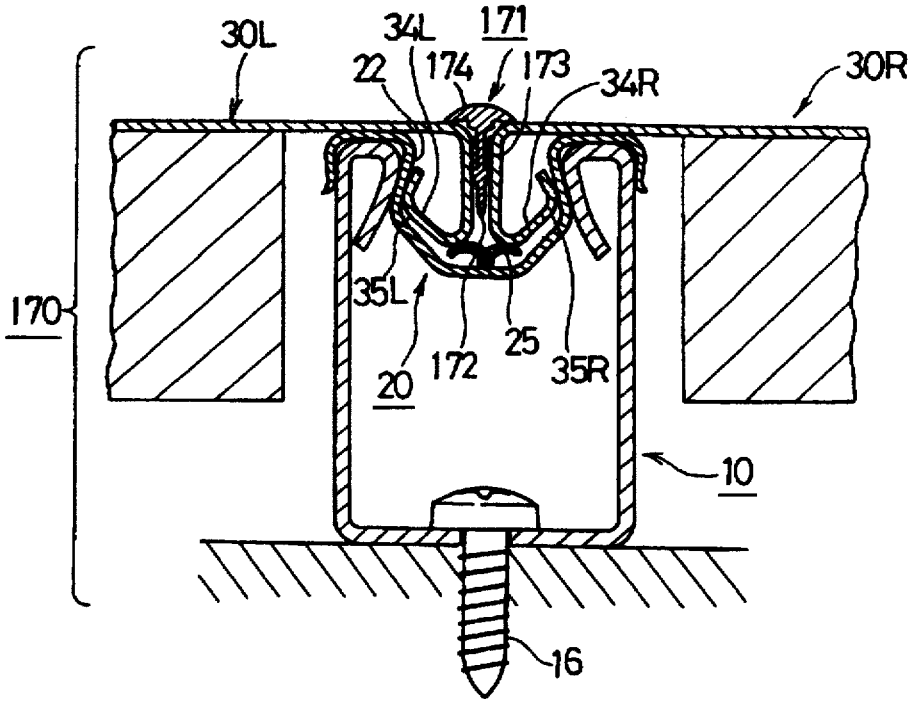
FIG. 12 is a horizontal cross-sectional view of a panel joining mechanism according to a fourth embodiment of the present invention.

FIG. 12 is a horizontal cross-sectional view of a panel joining mechanism according to a fourth embodiment of the present invention. The panel joining mechanism, generally denoted at 170, comprises a post 10, a panel joiner 20, a pair of panels 30L, 30R (L indicates a left panel and R a right panel), which are identical to those of the panel joining mechanism 1 according to the first embodiment, and a narrow joint finishing member 171 inserted between the elastic portions 34L, 34R of the panels 30L, 30R.

The narrow joint finishing member 171 comprises a wedge portion 172 positioned between the elastic portions 34L, 34R, a pair of retainers 173 integral with opposite sides of the wedge portion 172 and engaging with the elastic portions 34L, 34R for preventing the narrow joint finishing member 171 from being dislodged, and a head 174 joined to the wedge portion 172 and positioned on the panels 30L, 30R.

When the narrow joint finishing member 171 is driven into a position between the elastic portions 34L, 34R, the convex edges 35L, 35R are pressed strongly against the first slanted walls 22 of the panel joiner 20. Consequently, the panels 30L, 30R remain attached to the post 10 with increased strength.

For removing the panels 30L, 30R from the post 10, the narrow joint finishing member 171 is detached at first to facilitate the subsequent removing procedure.

Figure 13:
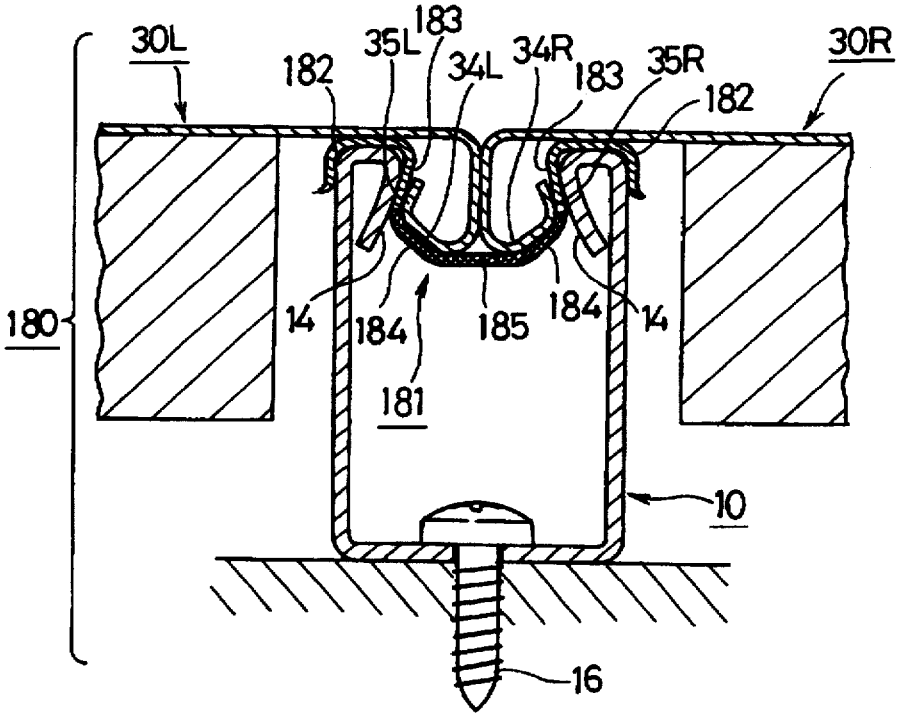
FIG. 13 a horizontal cross-sectional view of a panel joining mechanism according to a fifth embodiment of the present invention.

FIG. 13 is a horizontal cross-sectional view of a panel joining mechanism according to a fifth embodiment of the present invention. The panel joining mechanism, generally denoted at 180, comprises a post 10, a panel joiner 181, a pair of panels 30L, 30R (L indicates a left panel and R a right panel). The post 10 and the panels 30L, 30R are identical to those according to the first embodiment, and will not be described in detail below.

The panel joiner 181 comprises a pair of wings 182, a pair of first slanted walls 183 joined respectively to the wings 182, a pair of second slanted soft walls 184 joined respectively to the first slanted walls 183, and a rear soft wall 185 joining the second slanted soft walls 184 to each other. In the sixth embodiment, the second slanted soft walls 184 and the rear soft wall 185 jointly serve as an elastic pressing means for elastically pressing the elastic portions 34L, 34R of the panels 30L, 30R.

Because the second slanted soft walls 184 and the rear soft wall 185 are elastic, the elastic portions 34L, 34R are pushed upwardly in FIG. 13. As a consequence, the convex edges 35L, 35R are pressed against the respective slanted portions 14 of the post 10 through the first slanted walls 183, for thereby keeping the panels 30L, 30R strongly attached to the post 10.

The post 10 may be vertically mounted on the rim 52 around the floor pan 42 as shown in FIG. 7, the floor border 60 as shown in FIG. 8, or the building floor 50, or may be supported on a building wall. Therefore, the post 10 may be borne by any desired structure.

According to the present invention, as described above, a panel joining mechanism comprises a post, a panel joiner detachably fitted in the post, and a pair of substantially J- or S-shaped elastic portions on respective ends of panels, the elastic portions being detachably fitted in the panel joiner. The panels can easily be installed by attaching through simple pressing action the panel joiner to the post in its interior side, and attaching the elastic portions to the panel joiner.

To remove the panels and the panel joiner for decorative renovations, the elastic portions are easily detached from the panel joiner, and then the panel joiner is easily detached from the post. Therefore, the panels and the panel joiner can be attached or detached on the interior side easily at any time.

If the panel joiner has soft members, then the soft members can exert elastic forces to maintain the panels strongly attached to the post.

INDUSTRIAL APPLICABILITY

The panel joining mechanism according to the present invention can easily and securely be assembled and allows panels to be detached without undue forces and repeatedly. Consequently, the panel joining mechanism permits panels to define bounded spaces for various uses. Since the panel joining mechanism is highly water-tight and can be assembled in a limited space, it is particularly useful to produce a bathroom such as a unit bathroom or the like.

We claim:

1. A panel joining mechanism comprising:

a post composed of a flat rear wall adapted to be positioned in confronting relation to an attachment for being securely joined to said attachment, and a pair of side walls extending from respective opposite ends of said flat rear wall away from said attachment, said side walls having respective ends bent inwardly into a pair of respective bent portions with an opening defined therebetween;

a one piece panel joiner having a substantially inverted Ω-shaped cross section and elastically disposed between and detachably fitted over said bent portions; and at least a pair of panels having respective elastic portions on respective marginal side edges thereof;

said panel joiner being detachably fitted in said post through said opening, said panels being joined to said panel joiner with corresponding ones of said elastic portions detachably fitted said panel joiner and pushing the panel joiner to said bent portions of said post.

2. A panel joining mechanism according to claim 1, wherein each of said elastic portions has a substantially J-shaped cross section.

3. A panel joining mechanism according to claim 1, wherein each of said elastic portions has a substantially S-shaped cross section.

4. A panel joining mechanism according to claim 1, wherein said panel joiner has elastic pressing means for elastically pressing said elastic portions toward said bent portions of said post.

5. A panel joining mechanism according to claim 4, wherein said elastic pressing means comprises a soft member integral with said panel joiner.

6. A panel joining mechanism according to claim 1, further comprising:

a second post positioned adjacent to said first-mentioned post and having a flat rear wall adapted to be positioned in confronting relation to said attachment for being securely joined to said attachment; and an accessory attachment plate extending between said first-mentioned post and said second post, said accessory attachment plate being detachably joined to back surfaces of said respective flat rear walls of said first mentioned post and said second post, for supporting an accessory detachably thereon with one of said panels being positioned between said accessory attachment plate and said accessory.

7. A panel joining mechanism according to claim 6, wherein said one of said panels has a plurality of through holes defined therein from a face side to a back side thereof and extends between said first-mentioned post and said second post, with said elastic portions of said marginal side edges of said one of said panels being detachably fitted in said first-mentioned post and said second post, the arrangement being such that said accessory attachment plate is joined to said first-mentioned post and said second post when said one of said side panels is detached from said first mentioned post and said second post, and said accessory joining mechanism further comprises fasteners extending through said through holes for attaching the accessory to said accessory attachment prate when said one of said panels is attached to said first-mentioned post and said second post.

8. A panel joining mechanism according to claim 1, wherein said panel joining mechanism is water-tight.

9. A panel joining mechanism according in claim 1, further comprising wedge means for pressing said elastic portions toward said bent portions of said post.

10. A panel joining mechanism according to claim 1 further including sealant means disposed in said joiner for sealingly joining said elastic portions together.

11. A panel joining mechanism according to claim 1, wherein said respective elastic portions of said panels abuttingly engage each other when said elastic portions are fitted in said panel joiner.

12. A panel joining mechanism according to claim 1, wherein said panel joiner is completely concealed by said panels when the elastic portions of the panels are fitted in said panel joiner.

13. A panel joining mechanism comprising:

a rigid channel-shaped post having end edges bent inwardly toward each other with an opening defined therebetween;

a panel joining fitted to the rigid post so as to cover said opening including a convex portion disposed within said post and a pair of panels with elastic edges portions detachably fitted within said convex portion of said panel joiner such that said panel joiner presses said elastic edges portions said bent end edges of the rigid post.

14. A panel joining mechanism according to claim 13, wherein said panel joiner further includes wing portions detachably fitted over said bent end edges of the rigid post.

15. A panel joining mechanism according to claim 13, wherein said panel joiner further includes elastic pressing means disposed with said convex portion for elastically pressing said elastic edge portions of said panel towards said bent end edges of said post.

16. A panel joining mechanism according to claim 15, wherein said elastic pressing means comprises a soft member composed of a material softer than other portions of the panel joiner and formed integrally therewith.

17. A panel joining mechanism according to claim 13, further including wedge means detachably fitted between said elastic edge portions of said panel for pressing said panel joiner into secure engagement with said bent end edges of said rigid post.

18. A panel joining mechanism according to claim 13, wherein said respective elastic portions of said panels abuttingly engaged each other when said elastic portions are fitted in said panel joiner.

19. A panel joining mechanism according to claim 13, wherein said panel joiner is completely concealed by said panels when the elastic portions of the panels are fitted in said panel joiner.

20. A kit of components for securely and detachably joining panels together, comprising:

at least one rigid, channel-shaped post having bent end edges facing each other in confronting relation so as to define an opening therebetween;

at least one single piece panel joiner adapted to the detachably fitted to said rigid post for covering said opening, said panel joiner including a convex portion adapted to be disposed within said rigid post and wing portions adapted to be fitted over said bent and edges of said rigid post; and a pair of panels with elastic edge portions adapted to extend over the wing portions and to be detachably fitted in said convex portion of said convex portion of said panel joiner when said convex portion is disposed within said post.

21. A kit according to claim 20, wherein said panel joiner further includes elastic pressing means for elastically pressing said elastic edge portions of the panels toward said bent end edges of said post.

22. A kit according to claim 21, wherein said elastic pressing means comprises a soft member composed of a material softer than other portions of said panel joiner and formed integrally therewith.

23. A kit according to claim 20, comprising:

a plurality of said rigid, channel-shaped posts;

a plurality of said panel joiners; and an accessory attachment plate adapted to extend between a pair of said rigid posts, said accessory attachment plate being adapted to be detachably joined to back attachment surface of said post independent of said panel joiners and said panels, for supporting an accessory detachably thereon with one said panels being positioned between said accessory attachment plate and the accessory.

24. A kit according to claim 23, wherein one of said has a plurality of through holes defined therein from side to a back side thereof, and said kit further comprises screws for extending through said through holes to attach said accessory to said accessory attachment plate when said one of said panels is attached between a pair of said posts.

25. A kit according to claim 20, wherein said respective elastic portions of said panels are adapted to abuttingly engaged each other when said elastic portions are fitted in said panel joiner.

26. A kit according to claim 20, wherein said panels completely conceal said panel joiner when the elastic portions of the panels are fitted in said panel joiner.

27. A panel joining mechanism comprising:

a post composed of a flat wall adapted to be positioned in confronting relation to an attached for being securely joined to said attachment, and a pair of side walls extending from respective opposite ends of said flat rear wall away from said attachment, said side walls having respective ends bent inwardly into a pair of respective bent portions with an opening defined therebetween;

a one piece panel joiner having a substantially inverted Ω-shaped cross section and elastically disposed between and detachably fitted said bent portions; and at least a pair of panels having respective elastic portions on respective marginal side edges thereof;

said panel joiner being detachably fitted in said post through said opening, and said panels being joined to said panel joiner with corresponding ones of said elastic portions detachably fitted within said panel joiner and said post.

28. A panel joining mechanism comprising:

a rigid channel-shaped post having end edges bent inwardly toward each other with an opening defined therebetween;

a one piece panel joiner elastically detachably fitted to the rigid post so as to cover said opening, said panel joiner including a convex portion disposed within said post;

a pair of panels with elastic edge portions detechably fitted within said convex portion of said panel joiner such that the panel joiner presses said elastic edge portions toward said bent end edges of the rigid post; and said convex portion of said panel joiner and said elastic edge portions of said panels each having slanted engagement surfaces which are slidable relative to each other for facilitating insertion and removal of said elastic edges portions within said convex portion.

* * * * *

UNITED STATES PATENT AND TRADEMARK OFFICE

CERTIFICATE OF CORRECTION

PATENT NO. : 5,692,345

DATED : December 2, 1997

INVENTOR(S) : Yukinori Mogaki; Shigeru Suzuki; and Shunroku Seno

It is certified that error appears in the above-indentified patent and that said Letters Patent is hereby corrected as shown below:

On title page, item [75],

Inventors: Change "Shigieru Suzuki" to --Shigeru Suzuki--.

Column 5, line 27, change "pests" to --posts--.

Column 8, line 45, before the period, insert (again through simple pressing action)

Column 9, line 19, after "fitted" insert --within--.

Column 9, line 61, change "prate" to --plate--.

Column 10, line 22, after "portions" insert --toward--.

Column 11, line 13, after "with one" insert --of--

Column 11, line 16, after "said" insert --panels--.

Column 11, line 17, after "from", insert --a face--.

Signed and Sealed this

Twenty-first Day of April, 1998

Bruce Lehman

*Attest:*

BRUCE LEHMAN

*Attesting Officer*

*Commissioner of Patents and Trademarks*